United States Patent [19]

Milek

[11] Patent Number: 4,752,134

[45] Date of Patent: Jun. 21, 1988

[54] MOBILE CONCRETE MIXER

[76] Inventor: Robert C. Milek, 6560 Stones Throw Dr., Omaha, Nebr. 68152

[21] Appl. No.: 131,506

[22] Filed: Dec. 11, 1987

[51] Int. Cl.[4] ..... B28C 7/06

[52] U.S. Cl. ..... 366/27; 366/46; 366/49; 366/186

[58] Field of Search ..... 366/1, 2, 6, 10, 26, 366/27, 28, 29, 30, 41, 42, 45, 46, 49, 64, 66, 184, 185, 186, 194, 195, 241, 271, 297, 298, 299, 325, 327

[56] References Cited

U.S. PATENT DOCUMENTS

| | | | |
|---|---|---|---|
| 3,263,971 | 8/1966 | Farnham | 366/26 |
| 3,759,492 | 9/1973 | Hall | 366/49 |
| 3,904,723 | 9/1975 | Prince | 366/66 |
| 3,917,236 | 11/1975 | Hanson | 366/49 |
| 4,164,597 | 8/1979 | Smith | 366/66 |

*Primary Examiner*—Robert W. Jenkins

*Attorney, Agent, or Firm*—Zarley, McKee, Thomte, Voorhees & Sease

[57] ABSTRACT

A mobile concrete mixer comprising an elongated wheeled frame adapted to be connected at its forward end to a prime mover such as a truck or the like to enable the mixer to be moved from one location to another. An elongated conveyor support is pivotally mounted on the wheeled frame and has a hydraulic cylinder operatively secured thereto to enable the rearward end thereof to be raised to the desired discharge height. A conveyor belt is movably mounted on a conveyor support and has an elongated concrete mixer hopper positioned thereover. The lower end of the concrete mixer hopper is open to provide communication between the interior of the hopper and the upper portion of the conveyor belt. Mixing paddles or mixing discs are operatively mounted in the interior of the hopper and are designed to mix concrete materials deposited in the hopper as the conveyor belt is moved upwardly.

17 Claims, 7 Drawing Sheets

MOBILE CONCRETE MIXER

BACKGROUND OF THE INVENTION

This invention relates to a concrete mixer and more particularly to a mobile concrete mixer which may be utilized to mix concrete materials in either a continuous or batch type manner. Further, the mobile concrete mixer of this invention includes means for selectively vertically adjusting the discharge height of the same.

Historically, concrete has been mixed in a variety of devices such as rotary drum mixers, pug mills, vertical shaft turbine mixers, tub type ribbon mixers, etc.

Rotary drum mixers are, by nature, limited in mixing speed due to the presence of centrifugal force within the drum which requires longer mixing time to achieve the required mixing. Rotary drum mixers are normally tilted to discharge the materials therefrom which means that the mixed concrete must be gathered in a collecting hopper to regulate transfer into hauling units. The requirement of such hoppers, and the bulk of the drum design, results in discharge height requirements which are not compatible with mobile concrete plants.

Turbine mixers, which normally have a vertical shaft and mixing plows rotating within a circular housing, will mix the concrete materials faster than a rotary drum mixer but the diameter of the turbine mixers necessarily becomes excessively large when the capacity of the same is increased to equal the desired batch capacity of approximately ten cubic yards.

Tub type ribbon mixers are likewise large and bulky and require a discharge collecting hopper or a discharge conveyor which is not suitable for use with mobile concrete plants.

Pug mill type mixers, with the usual dual counter rotating shafts with mixing paddles, require heavy construction, wear-reducing side plates, high horsepower, and close tolerances between the rotating paddles and the housing to ensure complete mixing of the batch. Such pug type mixers also require a large discharge type collecting hopper which likewise increases height requirements and causes the same to be incompatible with mobile concrete plants.

It is therefore a principal object of the invention to provide a high capacity mobile concrete mixer.

Yet another object of the invention is to provide a mobile concrete mixer which has a low-charging height and an adjustable discharge height which may be utilized with any mobile or stationary batching system for either batch type mixing or continuous type mixing.

Still another object of the invention is to provide a mobile concrete mixer which may be used to mix concrete in either a continuous or batch type manner.

Still another object of the invention is to provide a mobile concrete mixer which is designed to mix aggregate, cement and water in either a batch fashion or in a continuous fashion and convey the mixed concrete into hauling units such as dump trucks, agitator trucks, mobile concrete mixers or the like.

Yet another object of the invention is to provide a mixer of the type described which may be utilized to transfer mixed concrete into hoisting buckets or pump units.

Yet another object of the invention is to provide a mobile concrete mixer which eliminates the need for a batch hopper as in prior art devices.

Still another object of the invention is to provide a mobile concrete mixer wherein an elongated conveyor means is mounted upon a wheeled frame means which may be pulled by a prime mover and wherein the conveyor means may be raised or lowered to vary the discharge height thereof.

A further object of the invention is to provide a mobile concrete mixer including a unique mixing apparatus located within a hopper positioned over a conveyor belt with the mixer being designed to not only properly mix the concrete materials but to also ensure that the same is mixed with a minimum of horsepower being required.

SUMMARY OF THE INVENTION

A mobile concrete mixer is described which may be used to mix concrete materials such as aggregate, cement and water in either a batch fashion or a continuous fashion and convey the mixed concrete into hauling units such as dump trucks, agitator trucks, mobile concrete mixers or the like. Further, the mixer of this invention may be utilized to transfer mixed concrete into hoisting buckets or pump units.

The mobile concrete mixer of this invention includes an elongated wheeled frame means having means on the forward end thereof for connection to a prime mover such as a truck or the like to enable the mixer to be moved from location to location. An elongated conveyor support is pivotally mounted on the wheeled frame means and has means associated therewith to enable the rearward of discharge end thereof to be raised to the desired discharge height. A conveyor belt means is movably supported on the conveyor support and includes an upper conveying portion and a lower return portion. An elongated concrete mixer hopper is positioned over the upper conveying portion of the conveyor belt means and has a mixing means mounted therein which is designed to mix the concrete materials in either a batch or continuous manner. The concrete materials are dumped into the mixer hopper and the mixing means therein is operated to mix the materials. During operation, the concrete materials are introduced at the lower end of the hopper means simultaneously or in an accumulative fashion. The flat conveyor belt is moved forwardly and upwardly at a slow or variable speed to introduce the materials to the mixer means as the batching cycle continues. Upon completion of the mixing cycle, the flat conveyor belt is accelerated to provide a fast discharge of the mixed concrete into transporter systems. In a continuous mixing situation, the mixing speed and the direction of rotation of the mixing means, as well as the flat conveyor belt speed, may be varied to ensure continuous mixing of the concrete materials as they pass from the lower to upper end of the mixing system. The upper end of the conveyor belt may be vertically adjusted to accommodate different types of transporting devices or hauling means or pumping systems.

In one embodiment, the mixing means is comprised of a plurality of mixing paddles mounted on rotatable shafts which extend between the walls of the mixer hopper. In a modified form of the invention, the mixer means is comprised of a plurality of oval-shaped mixing discs mounted on the shafts.

DESCRIPTION OF THE PREFERRED EMBODIMENT

Figure 3:
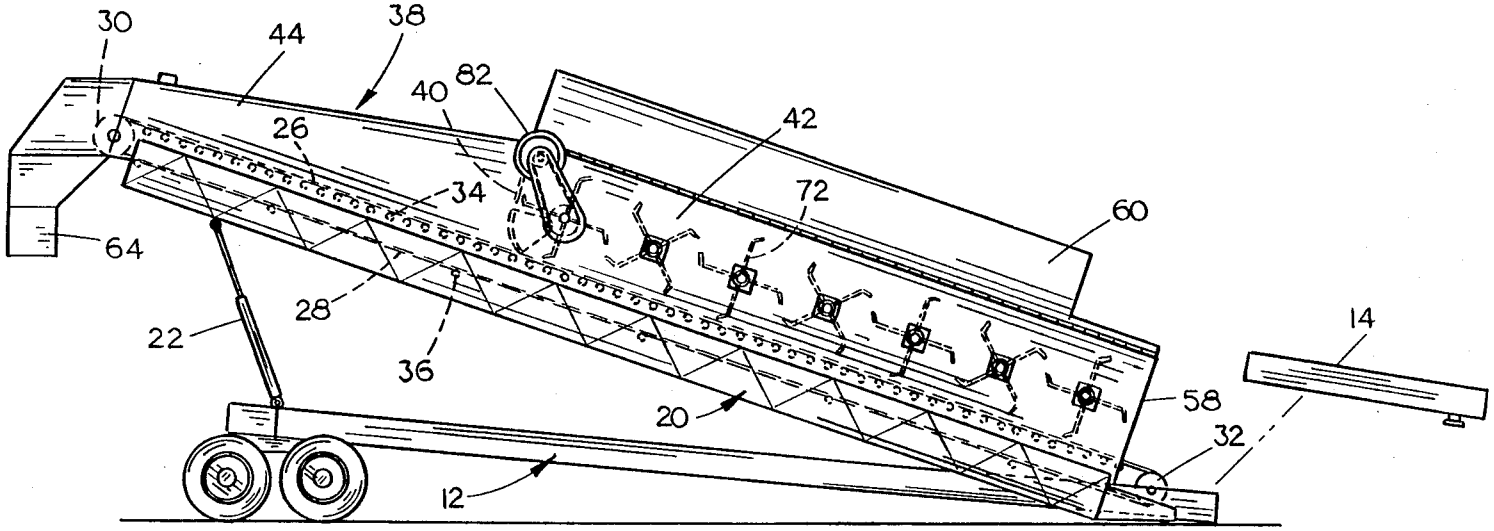
FIG. 3 is a side elevational view of the mobile concrete mixer of this invention.

The mobile concrete mixer of this invention is referred to generally by the reference numeral 10 and includes a wheeled frame means 12 having means at the forward end 14 thereof for connection to a prime mover 16 such as a truck or the like. The connection means 14 may be comprised of a conventional fifth wheel type arrangement which may be either permanently affixed to the mixer or removably mounted thereon as illustrated in FIG. 3. Frame means 12 includes wheels 18 at the rearward end thereof for supporting the same.

Figure 1:
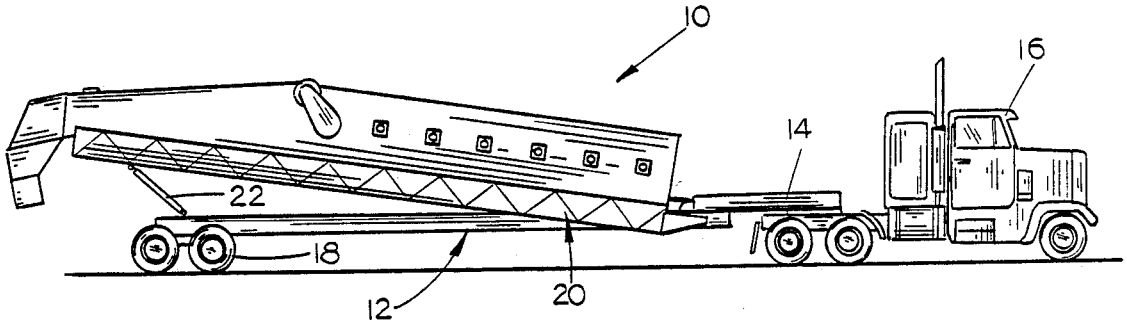
FIG. 1 is a side view of the mobile concrete mixer of this invention being pulled by a prime mover such as a truck.

The numeral 20 refers generally to a conveyor support means which is pivotally mounted at its forward end to the frame means 12 adjacent the forward end thereof as illustrated in the drawings. The precise manner in which the conveyor means 20 is pivotally connected to the frame means 12 is not important since the same could be accomplished in a variety of different ways. A hydraulic cylinder means 22 is provided at the rearward end of the support means 20 for selectively raising and lowering the rearward end of the conveyor support means as it is illustrated in FIG. 1.

A flat conveyor belt means 24 (FIG. 8) is operatively movably mounted on the conveyor support means in conventional fashion and includes an upper conveying portion 26 and a lower return portion 28. Conveyor belt 24 is positioned between a head pulley or roller 30 and a tail pulley or roller 32 as illustrated in the drawings. As also seen in the drawings, the upper conveying portion 26 is supported by a plurality of rotatable rollers 34 which are positioned therebelow in a transverse manner with respect to the movement of the conveyor belt. Similarly, return portion 28 is movably supported by a plurality of rotatable rollers 36. Suitable power means is provided for rotating either or both of the pulleys 30 and 32 so that the upper conveying portion 26 moves upwardly and rearwardly from the forward end of the conveyor support means.

Figure 7:
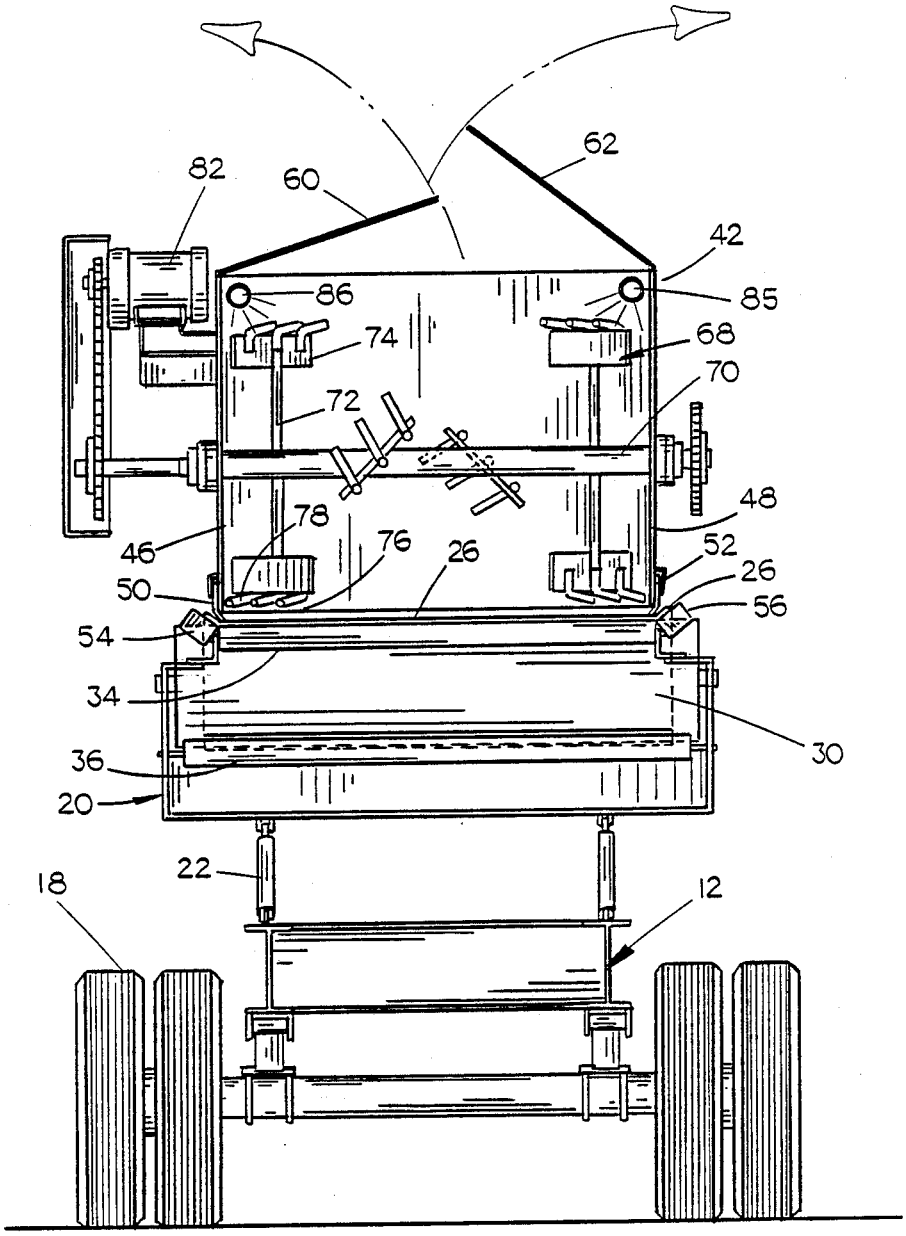
FIG. 7 is a sectional view seen along lines 7—7 of FIG. 4.

The numeral 38 refers to an enclosure means which is positioned over the upper conveying portion 26 which is provided by an end wall 40 to define a mixing hopper 42 and a discharge shroud 44. Mixing hopper 42 includes opposite side walls 46 and 48, the lower ends of which terminate above the upper conveying portion 26. Flexible seals 50 and 52 extend downwardly from the lower ends of walls 46 and 48 and engage the upper surface of upper conveying portion 26 as illustrated in FIG. 7 to provide a seal between the interior of the hopper means and the conveyor belt. As also seen in FIG. 7, inclined rollers or supports 54 and 56 are provided at the sides of upper conveying portion 26 to cause the sides of the conveyor belt to be deflected upwardly to aid in presenting the concrete materials within the mixing hopper 42 from escaping from the lower end thereof.

Mixing hopper 42 also includes a forward end wall 58 and a pair of top covers 60 and 62 which may be opened as illustrated in FIG. 7 to service the components within hopper 42 or to clean the same. Covers 60 and 62 are provided with a suitable sealed inlet opening 63 permit the delivery of the concrete materials such as aggregate and cement into the interior of the hopper 42.

Figure 2:
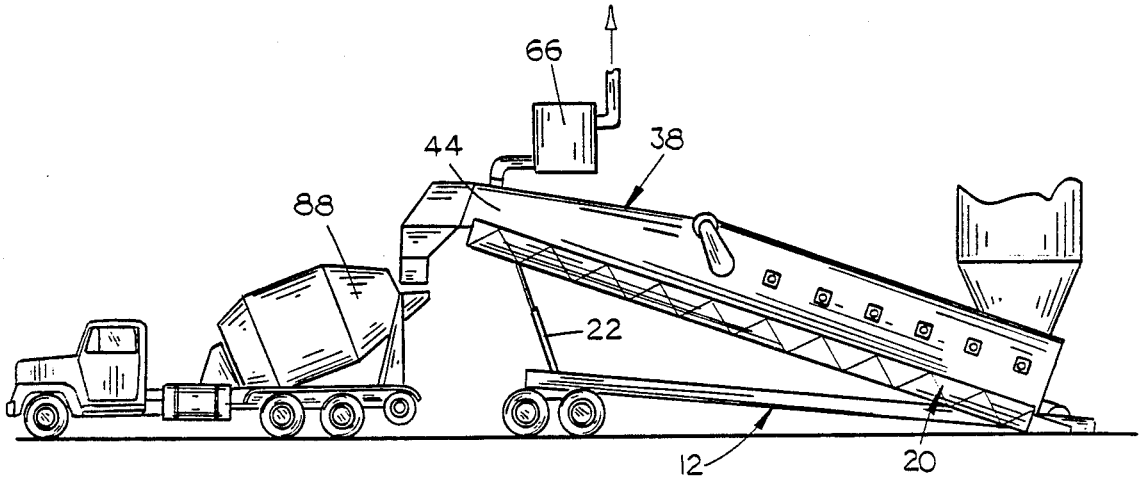
FIG. 2 is a side view illustrating the mobile concrete mixer of this invention being positioned in an operative position.

Shroud 44 seals the upper end of the conveyor and communicate with a discharge spout 64. Preferably, the upper interior of shroud 44 is in communication with a conventional dust filter 66 as seen in FIG. 2. It should be noted that the upper end of wall 40 has an opening formed therein to permit the interior of hopper 42 to communicate with the interior of shroud 44 so that dust in hopper 42 will also be delivered to the dust filter 66.

Figure 6:
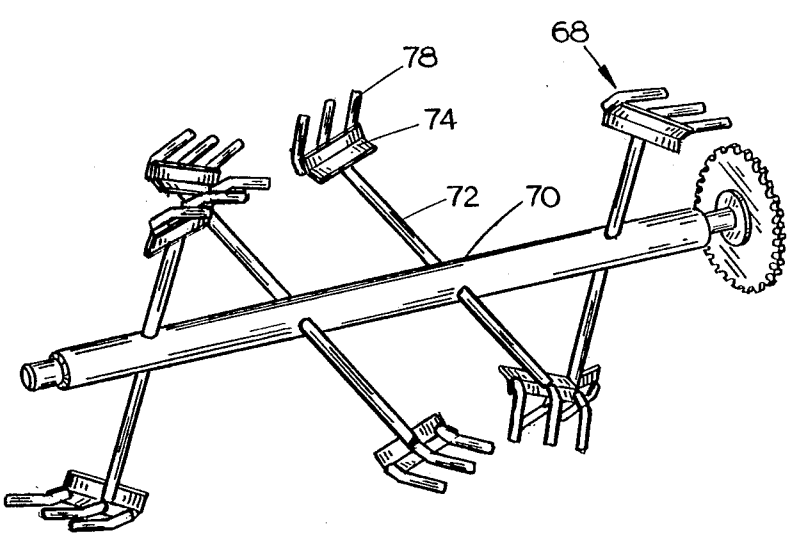
FIG. 6 is a perspective view of the mixing paddles.
Figure 5:
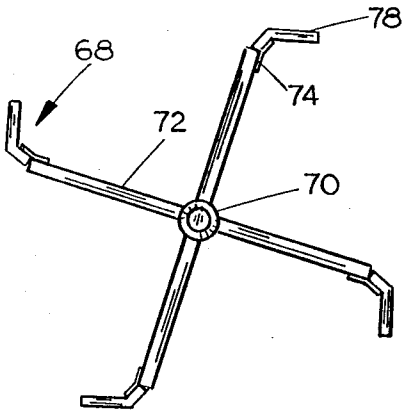
FIG. 5 is a side view of the mixing paddles mounted within the mixing hopper.

Although a variety of different types of mixing devices may be utilized within mixing hopper 42, it is preferred that mixing means be comprised of a plurality of mixing paddles 68 (FIG. 6) to be utilized which are mounted on transversely extending rotatable shafts 70 rotatably mounted in side walls 46 and 48. Mixing paddles 68 comprise a shaft or arm 72 mounted on shaft 70 and which extends outwardly therefrom. Plate 74 is mounted on the outer end of arm 72 and is preferably disposed at an angle with respect to the longitudinal axis of the mixing hopper 42. As seen in FIG. 7, the length of the arm 72 and the plates 74 are positioned thereon such that a gap 76 is provided between the plates 74 and the upper conveying portion 26. Gap 76 is provided to permit the passage of coarse materials therebetween. In other words, if plates 74 are positioned closely adjacent the upper surface of conveying portion 26, coarse materials such as rocks could be impinged therebetween which would cause undue wear of the associated components. To ensure that adequate mixing is provided adjacent the upper surface of the conveying portion 26, each of the plates 74 has a plurality of spaced-apart teeth or tines 78 extending therefrom at an angle with respect thereto. The teeth 78 pass very closely adjacent the upper conveying portion 26 in a sweeping motion to ensure that the concrete materials are adequately mixed. Preferably, several of the mixing paddles are mounted on each of the shafts 70 and are disposed at various angles to ensure that upper mixing is achieved. Each of the shafts 70 is interconnected by means of a chain 80 which is operatively connected to a motor 82 so that all of the mixing paddles will be rotated. The mixing paddles may be rotated in the same direction or in opposite directions as would be achieved due to the chain wrap illustrated in FIG. 8. The conveyor belt is powered by a suitable computer control power means to enable the speed of the belt to be moved in accordance with the particular program being utilized.

Figure 8:
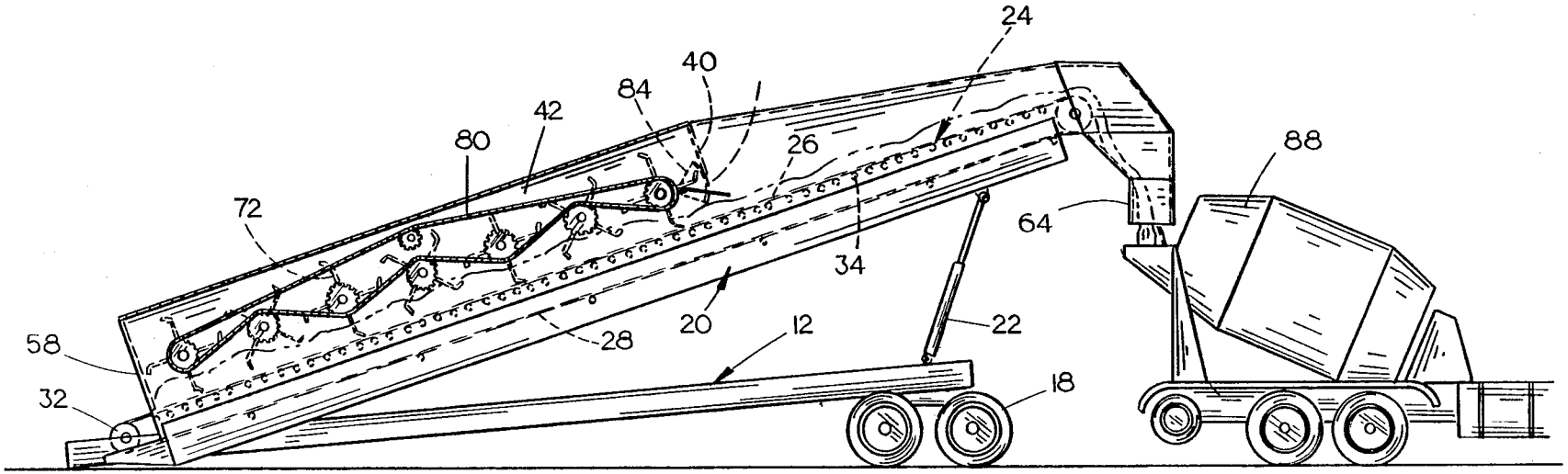
FIG. 8 is a side view of the mixer of this invention in an operational position with portions thereof cut away to more fully illustrate the invention.

As seen in FIG. 8, the lower end of the end wall 40 terminates above the conveyor portion 26 to provide an opening 83 (FIG. 4) therebelow. Opening 83 is selectively closed by means of a clam shell type gate 84 which is rotatably mounted within hopper 42 to control the discharge of the concrete materials from mixing hopper 42. Hopper 42 is also provided with spray bars 85 and 86 (FIG. 13) which are in communication with a source of water to enable water to be supplied to the interior of the hopper 42.

Figure 4:
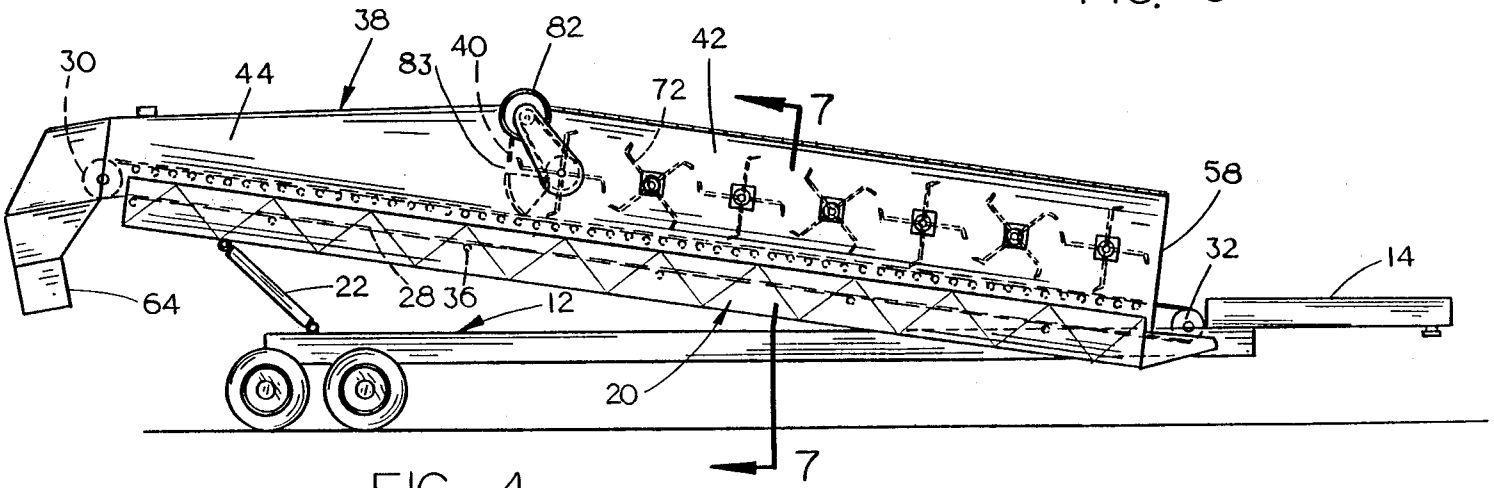
FIG. 4 is a view similar to that of FIG. 3 except that the conveyor means and mixing hopper have been lowered to a transport position.

FIGS. 1 and 4 illustrate the concrete mixer of this invention in a transport position with FIG. 1 illustrating the mixer axially connected to a prime mover such as a truck 16. In the transport position illustrated in FIGS. 1 and 4, the hydraulic cylinder means 22 is in the retracted position so that the discharge end of the mixer is at its lowermost position to enable the mixer to be transported from one location to another. When the mixer has been delivered to the desired site, the mixer would normally be disconnected from the truck 16 with the forward end thereof positioned on the ground as illustrated in FIG. 2. The hydraulic cylinder means 22 is then extended to raise the discharge end of the mixer to the desired height depending upon the particular operation involved. It can be seen from the drawings that the discharge height of the mixer may be selectively raised to the desired height without changing the charging height of the apparatus. As seen in FIG. 2, the charging height of the mixer will be relatively low due to the fact that the forward end of the wheeled frame mean is always positioned on the ground.

If the mixing operation is to be the batch type, the aggregate and cement will be introduced into the lower end of the hopper means 42, through the opening provided in covers 60 and 62, and water delivered to the interior of hopper 42 through the spray bars 85 and 86. The shafts 70 will be simultaneously rotated so that the paddles 68 will be rotated through the materials to adequately mix the same. Normally, the conveyor belt will be actuated so that the conveyor belt will convey the material upwardly and rearwardly to all of the mixing paddles. The conveyor belts may also be reversed to turn the materials to the mixing paddles to ensure proper mixing. When the materials within hopper 42 have been adequately mixed in the batch situation, gate 84 will be raised and the conveyor belt speed increased so that the material within the hopper 42 will be conveyed upwardly and rearwardly to the discharge end of the mixer for deposit into the hauling unit 88. Any dust produced within the enclosure 38 will be drawn outwardly therefrom into the dust filter 66.

In a continuous mixing situation, the paddle speed and direction of rotation, as well as the flat belt conveyor speed, may be varied to ensure continuous mixing of the concrete materials as they pass from the lower to upper end of the mixing system. In other words, the materials will be introduced into the lower end of the hopper 42 in a continuous fashion and the conveyor belt will move upwardly and rearwardly beneath hopper 42 which will cause the materials within hopper 42 to be moved upwardly and rearwardly into contact with the mixing paddles and eventually outwardly from the hopper 42 beneath the gate 84. The discharge opening beneath the gate 84 will be controlled depending upon the desired mixing speed.

Figure 10:
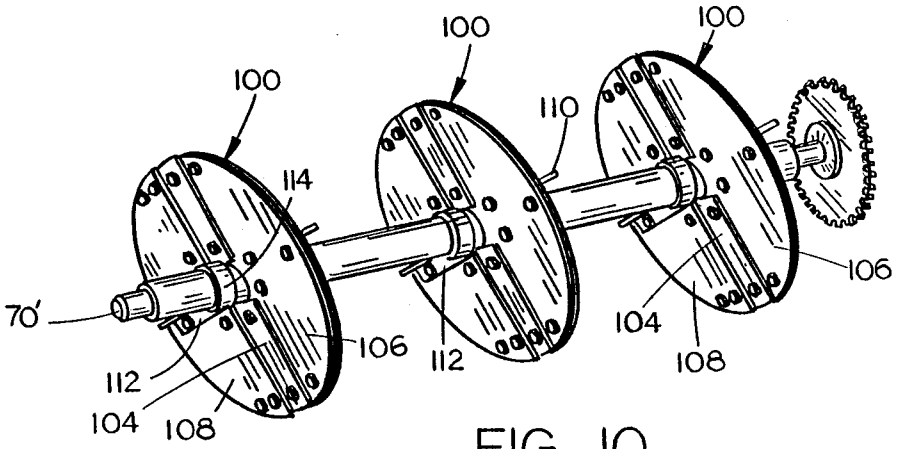
FIG. 10 is a perpsective view of the mixing disc assembly in the embodiment of FIG. 9.
Figure 11:
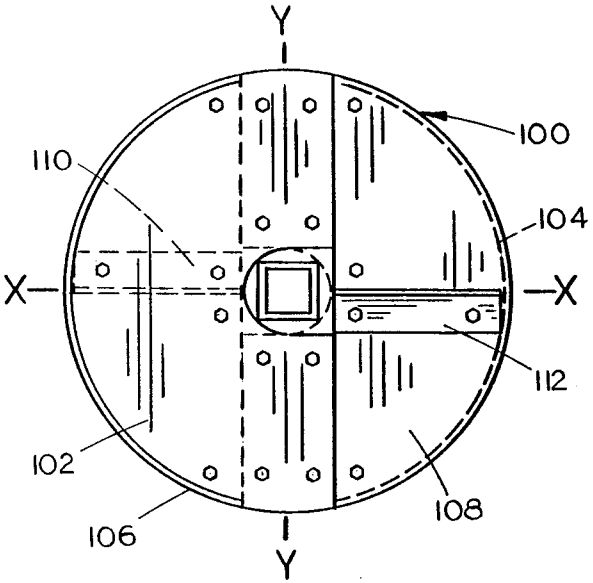
FIG. 11 is an end view of one of the mixing discs of FIG. 10.
Figure 9:
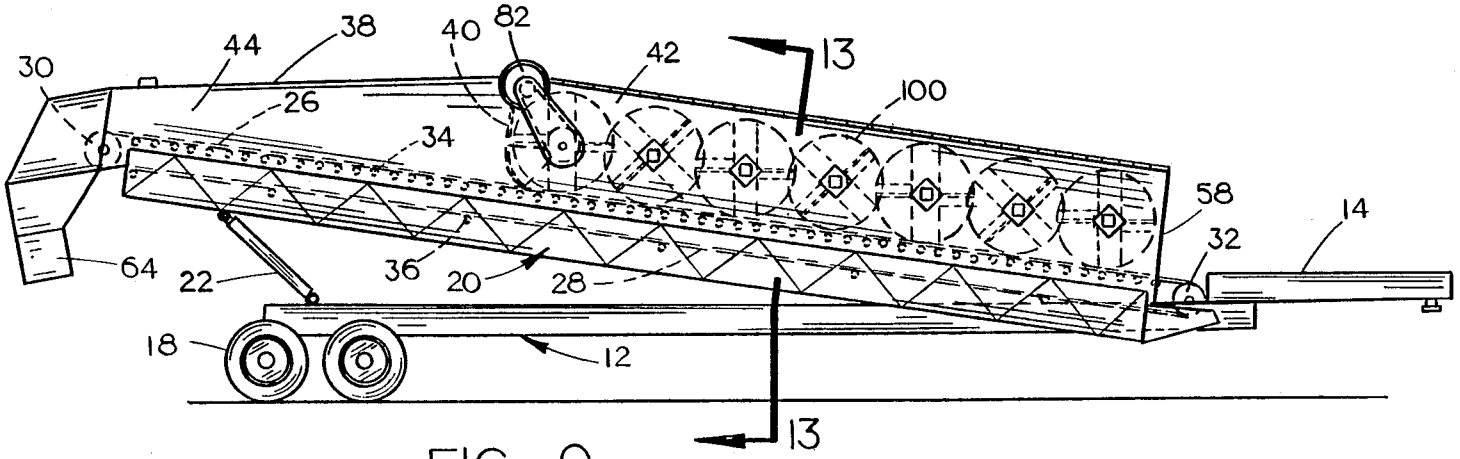
FIG. 9 is a view similar to FIG. 1 except that a modified form of the mixing means is mounted within the mixing hopper is illustrated.
Figure 12:
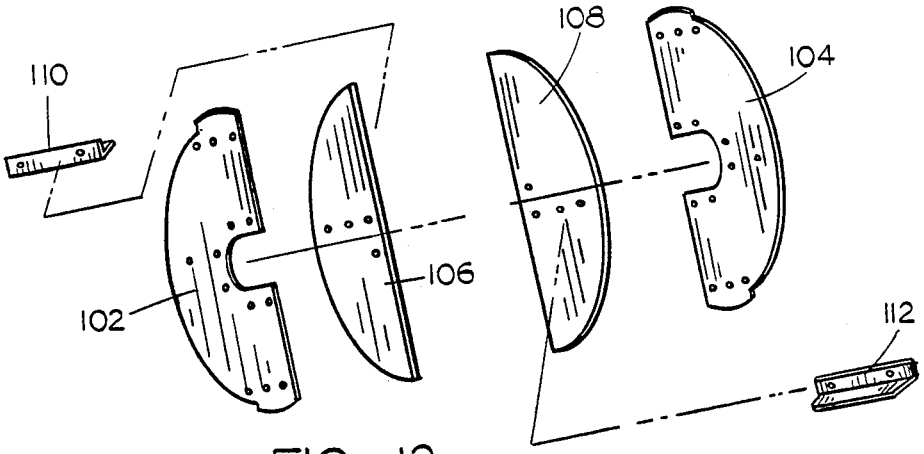
FIG. 12 is an exploded perspective view of one of the mixing discs of FIG. 10.

A modified form of the mixing means is illustrated in FIGS. 9–13. Referring to FIG. 10, the mixing paddles 68 have been replaced by a plurality of mixing discs 100 which are mounted on the shafts 70′ in a spaced-apart relationship as clearly illustrated in the drawings. Each of the mixing discs 100 comprises a pair of metal backing plates 102 and 104 (FIG. 12) which are generally semi-circular in configuration and having a pair of semi-circular wear liners 106 and 108 positioned therebetween and bolted thereto as illustrated in the drawings. Wear liners 106 and 108 are preferably comprised of a molded polyurethane material and are designed to be removed from between the backing plates 102 and 104 when the peripheries thereof become worn. The mixing discs 100 also include a pair of angle-shaped mixing paddles 110 and 112 which are bolted to the face of the mixing disc which is exposed to the aggregate material. Although it is not readily apparent from the drawings, the mixing discs are oval-shaped so that the diameter is greater down the Y—Y axis than on the X—X axis. The oval shape is necessary to maintain minimum clearance during rotation between the periphery of the mixer disc and the belt surface. This close clearance prevents jamming of coarse material between the mixer discs and the conveyor belt.

Figure 13:
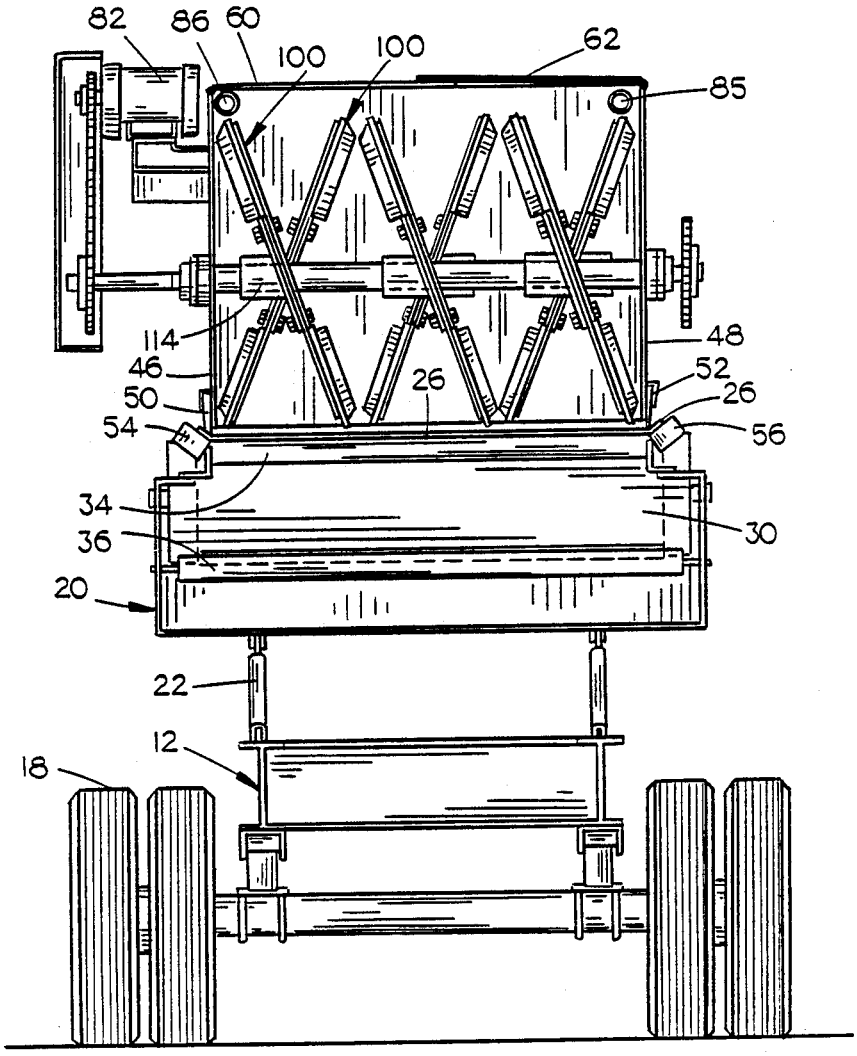
FIG. 13 is an enlarged sectional view seen on lines 13—13 of FIG. 9.

A hub 114 is bolted to the mixing discs and is mounted on the shaft 70′ and secured thereto by any suitable means such as bolts, keyways, etc. As seen in FIGS. 10 and 13, the mixing discs 100 are positioned relative to the shafts 70′ so that the plane thereof is disposed at an angle with respect to the longitudinal axis of the shaft 70′. The angular disposition of the mixing discs 100 on the shaft 70′ causes the mixing discs to "wobble" as the shaft 70′ is rotated so that the material coming into contact with the rotating discs 100 will be conveyed back and forth with the conveying and mixing action being enhanced by the paddles 110 and 112. Thus, each of the mixing discs on one shaft 70′, mixes the materials coming into contact therewith. If the mixing operation is of the batch type, the materials will be mixed by each set of the mixing discs on the individual shafts 70′. If the mixing operation is of the continuous type, the conveyor belt will be moved upwardly so that the material will be gradually moved from one set of mixing discs to the next set of mixing discs.

Thus it can be seen that a novel mobile concrete mixer has been provided which can be used for either batch or continuous type mixing operations. It can also be seen that a unique mobile concrete mixer has been provided wherein the charging height is relatively low but having means thereon for selectively adjusting the discharge height to accommodate various types of hoisting or pumping systems. It can further be seen that a high capacity mixing system has been provided utilizing a low charging height and an adjustable discharge height to enable the same to accommodate any mobile or stationary batching system for either batch type mixing or continuous type mixing. It can also be seen that the mobile concrete mixer of this invention achieves all of the desired results with a minimum of power requirements. It can therefore be seen that the invention accomplishes at least all of its stated objectives.

I claim:

1. A mobile concrete mixer, comprising, an elongated wheeled frame means having a forward end and a rearward end, means on the forward end of said wheeled frame means for connection to a prime mover, an elongated conveyor support means, having rearward and forward ends, pivotally mounted at its forward end to said wheeled frame means and being pivotally movable between a lowered transport position and a selectable elevated operating position, means for raising and lowering said conveyor support means, a conveyor belt means movably supported on said conveyor support means and including an upper conveying portion and a lower return portion, means for moving said conveyor belt means whereby said upper conveying portion moves from the forward end of said conveyor support means to the rearward end thereof, an elongated concrete mixing hopper means mounted above at least a portion of said upper conveying portion, said hopper means having upstanding forward and rearward ends, opposite sides, an upper end, and an open lower end which is positioned above said upper conveying portion, said rearward end of said hopper means having a discharge opening formed therein at least at its lower end, said hopper means adapted to receive concrete materials therein through its upper end, a mixing means in said hopper means for mixing the concrete materials therein, and means for selectively controlling the movement of said conveyor belt means whereby said conveyor belt means may be either operated to convey the mixed concrete from said hopper means through said discharge opening after the concrete materials have been mixed or to convey the concrete materials longitudinally within said hopper means as the mixing operation is taking place.

2. The mobile concrete mixer of claim 1 wherein said mixing means comprises a plurality of mixing paddle means rotatably mounted within said hopper means.

3. The mobile concrete mixer of claim 2 wherein a plurality of spaced-apart rotatable shafts extend between the opposite sides of said hopper means, said mixing paddles being operatively mounted on said shafts.

4. The mobile concrete mixer of claim 3 wherein a plurality of radially extending arms extend outwardly from said shafts within said hopper means, said paddle means being mounted on the outer ends of said arms.

5. The mobile concrete mixer of claim 4 wherein each of said paddle means comprises a plate member having spaced-apart fingers mounted thereon which extend therefrom.

6. The mobile concrete mixer of claim 5 wherein the length of said arms and said fingers is such that said fingers pass closely adjacent said conveying portion as said shafts are rotated.

7. The mobile concrete mixer of claim 4 wherein said shafts, arms and said plate members are arranged so that the plate members on adjacent shafts overlap but do not engage one another.

8. The mobile concrete mixer of claim 4 wherein at least some of said plate members are angularly disposed with respect to the rotational axis of said shafts.

9. The mobile concrete mixer of claim 1 wherein a clam-shell gate means selectively closes said discharge opening.

10. The mobile concrete mixer of claim 9 wherein said conveying portion of said conveyor belt means, rearwardly of said hopper means, is enclosed and is in communication with a dust filter.

11. The mobile concrete mixer of claim 1 wherein the upper end of said hopper means is selectively closable by a door means.

12. The mobile concrete mixer of claim 10 wherein an enclosure means encloses said conveying portion of said conveyor belt means, said enclosure means having a discharge opening at the rearward end of said conveying portion, and a dust filter means in communication with said enclosure means for removing the dust therefrom.

13. The mobile concrete mixer of claim 12 wherein an opening is provided at the upper end of said rearward end of said hopper means to permit dust in said hopper means to be drawn into said enclosure means by said dust filter means.

14. The mobile concrete mixer of claim 1 wherein said mixing means comprises a plurality of spaced-apart rotatable shafts extending between the opposite sides of said hopper means and a plurality of spaced-apart, substantially flat mixing discs mounted on each of said rotatable shafts, the plane of each of said mixing discs being disposed at an angle, other than 90°, with respect to the longitudinal axis of the rotatable shaft upon which it is mounted.

15. The mobile concrete mixer of claim 14 wherein each of said mixing discs are oval-shaped.

16. The mobile concrete mixer of claim 15 wherein each of said mixing discs comprise a pair of simi-circular backing plates having a pair of semi-circular wear liners positioned therebetween and means operatively securing at least one of the backing plates to the shaft upon which it is mounted.

17. The mobile concrete mixer of claim 1 wherein means selectively closes said discharge opening.

* * * * *